US005564634A

United States Patent [19]

Rouse et al.

[11] Patent Number: 5,564,634

[45] Date of Patent: Oct. 15, 1996

[54] RUBBER COMMINUTING APPARATUS

[76] Inventors: Michael W. Rouse, 325 Fairways; Morgan White, 5 McCall Cove, both of Vicksburg, Miss. 39180

[21] Appl. No.: 419,454

[22] Filed: Apr. 10, 1995

Related U.S. Application Data

[63] Continuation of Ser. No. 221,169, Mar. 31, 1994, abandoned.

[51] Int. Cl.[6] ..... B02C 7/06; B02C 7/14

[52] U.S. Cl. ..... 241/37; 241/259.1; 241/261.3; 241/DIG. 31

[58] Field of Search ..... 241/261.2, 261.3, 241/259.1, DIG. 31, 37

[56] References Cited

U.S. PATENT DOCUMENTS

| | | | |
|---|---|---|---|
| 2,699,095 | 1/1955 | Irwin | 241/37 X |
| 3,309,031 | 3/1967 | McMahon et al. | 241/37 |
| 3,604,645 | 9/1971 | Keyes, IV | 241/37 |
| 3,754,714 | 8/1973 | Reinhall | 241/34 |
| 4,269,365 | 5/1981 | Berggren | 241/261.2 X |
| 4,614,310 | 9/1986 | Tloczynski et al. | 241/259.2 |
| 4,627,578 | 12/1986 | Whyte | 241/30 |
| 4,700,900 | 10/1987 | Rowland | 241/37 |
| 4,878,997 | 11/1989 | Reinhall | 241/261.3 X |
| 5,238,194 | 8/1993 | Rouse et al. | 241/21 |

FOREIGN PATENT DOCUMENTS

| | | | |
|---|---|---|---|
| 3535245 | 4/1987 | Germany | 241/261.3 |

*Primary Examiner*—John Husar
*Attorney, Agent, or Firm*—Foley & Lardner

[57] ABSTRACT

A comminuting apparatus for rubber has two vertically mounted opposing facing grinding stones of large size having hollow centers. Interposed between these two stones, both of which, as stators, are fixed and do not rotate, is a single rotor having double-sided opposed abrasive grinding stone faces, mounted for rotation but floating laterally or horizontally in position between the two opposed fixed stones. The spacing between the opposed sets of grinding stones is set by increasing or decreasing the spacing between the outer most stator and the fixed inner stator. So long as the rotor rotates for grinding, the floating center stones will position themselves equally between the two stators so as to equalize the dynamic slurry pressure imposed during the grinding process upon the faces of the stones.

7 Claims, 1 Drawing Sheet

RUBBER COMMINUTING APPARATUS

This is a continuation of U.S. Ser. No. 08/221,169, filed on Mar. 31 1994, now abandoned, entitled IMPROVED RUBBER COMMINUTING APPARATUS.

BACKGROUND OF THE INVENTION

It is known that rubber scrap may be reduced to a useful fine size for recycling by grinding between abrasive grinding stones until the rubber is reduced to particle sizes of a fineness of 40 mesh or finer. Such abrasively ground rubber has beneficial properties in many uses and provides a constituent which may be recycled into both rubberized plastic products for beneficial physical properties or mixed with other materials to form useful compounds.

The prior art exemplified by British Patent 1,516,090 to Robinson et al., a series of patents currently owned by the Goodyear Tire and Rubber Company of Akron, Ohio, exemplified by Brubaker et al. U.S. Pat. No. 4,469,284, and applicant's prior issued U.S. Pat. No. 5,238,194 disclosing an improved method of grinding a rubber slurry to produce fine particulate rubber particles.

Prior art rubber comminuting utilizes a form of vertical grinding apparatus adapted from an abrasive grinder long used in the paint and pigment industry for the grinding of organic and metallic pigments for incorporation in paints. This apparatus utilizes a pair of opposed grinding stones: a top stone which is fixed to a plate adjustable vertically in spacing from and opposed face to face to a horizontally mounted grinding stone which is set upon a motor to rotate around a vertical axis. Both stones have hollow centers and grind ion mating faces which have the form of a flat torus. In each case the material to be ground is introduced as a slurry through an opening in the top stone to an open center space formed by the open centers of the stones. The rubber containing slurry passes between the two opposing faces during the grinding process and the ground slurry is collected in a collection region outside the outer rim of the stones and then further processed by screening, drying and the like to separate out the finely ground output rubber.

These mills, being designed for fine pigment production for paint, have a limited output production rate for producing similarly fine ground rubber. While various techniques, such as is shown in our prior patent for an improved method for grinding rubber, have increased the through put of finely ground rubber in a given period of time, these artificial pigment grinding machines have a definite upper practical production limit.

SUMMARY OF THE INVENTION

We have discovered that a suitable comminuting apparatus for rubber may be created by providing two vertically mounted opposing facing grinding stones of large size having hollow centers, and interposing between these two stones, both of which, as stators, are fixed and do not rotate, a single rotor having double-sided opposed abrasive grinding stone faces, mounted for rotation but floating laterally or horizontally in position between the two opposed fixed stones. In such an apparatus the spacing between the stones, which is critical for setting up optimum production rates of ground rubber slurry, is set by increasing or decreasing the spacing between the outer most stator and the fixed inner stator. So long as the rotor rotates for grinding, the floating center stones will position themselves equally between the two stators so as to equalize the dynamic slurry pressure imposed during the grinding process upon the faces of the stones. This permits the adjustment of a single stator to correctly position all four grinding stones to provide two parallel grinding paths emanating from a single central bore into a single collection region exterior to the rotating center stones.

It has been discovered that a device involving such parallel stone grinding may be readily set for proper grinding of fine particulate rubber by setting a water flow in and through the rotating stones and then adjusting the spacing between the stones by slowly closing the outer stator upon and towards the inward stator until a specific temperature rise is detected in the slurry passing between the center bore through the rotating stones and grinding faces to the outer bore. This temperature rise can be correlated to grinding rate to indicate optimum grinding capability. The stone's spacing can be set by monitoring temperature rise in a rubber containing slurry to produce an optimum through put of ground rubber.

It has further been determined that the relative rotary motion of the grinding stones of the invention is sufficient to move the slurry from the center bore through the grinding faces into the outer collection chamber without requiring the use of impellers. It appears that the grinding stones in fact function in some manner as a centrifugal pump, moving the slurry through the grinding stones, as disclosed in our prior U.S. Pat. No. 5,238,194 to Rouse.

It is, therefore, an object of the invention to disclose an improved comminuting apparatus for rubber particles with a significantly higher throughput than the pigment comminuting mills of the prior art.

It is a further object of the invention to disclose a comminuting apparatus for fine rubber particles which does not require impellers or differential pumps to provide for slurry flow through the grinding faces.

It is a further object of the invention to disclose a device for the abrasive grinding of rubber which has a significantly higher throughput than the vertical pigment grinding mills of the prior art. These and other objects of the invention can be more clearly seen from the detailed description of the preferred embodiment which follows.

DETAILED DESCRIPTION OF THE INVENTION

Figure 1:
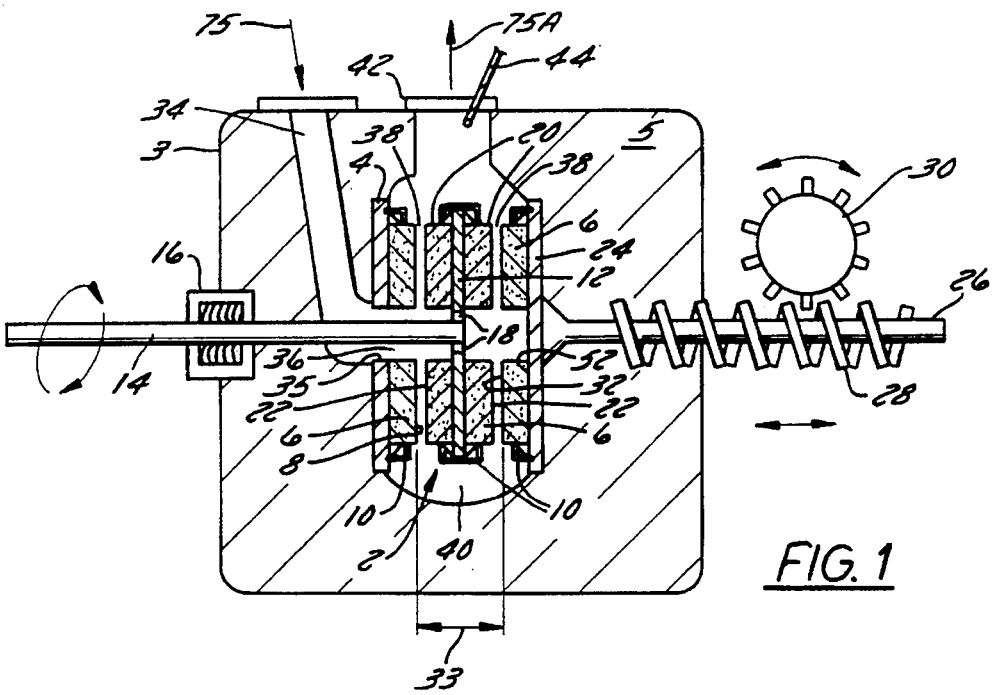
FIG. 1 is a cross-section view of the grinder of the invention.

Referring to FIG. 1, I show, in cross-section form, the inventive double disk grinder of the invention and method. The double disk grinder comprises a casing 3, a substantially strong, steel housing having a hinged end section 5 which can be swung away to open the interior of the casing 3 for inspection, removal or maintenance of the interior mechanism described below.

Within the casing 3, against an interior wall thereof, is mounted a fixed stator 4. The stator 4 is a flat, metal plate fixedly mounted to the casing 3 and having a central bore or opening 35 in the center thereof.

Figure 2:
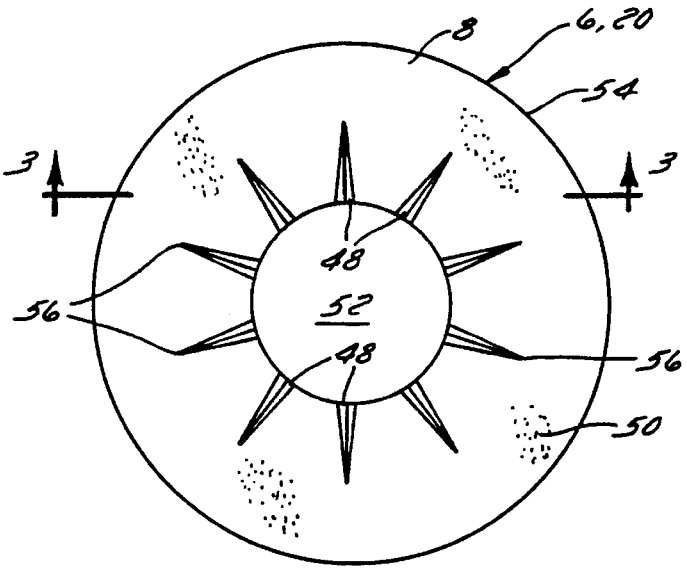
FIG. 2 is a face view of a typical abrasive grinding stone of the invention.
Figure 3:
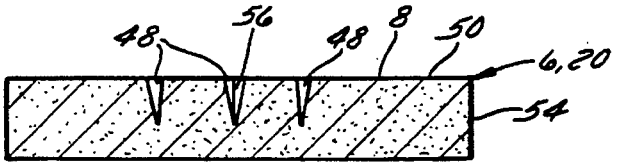
FIG. 3 is a section through the stone shown in FIG. 2.

Mounted to the stator 4 is a stator abrasive stone 6. Each of the abrasive stones described herein is of the form shown in FIG. 2 in face view and in FIG. 3 in cross-sectional view. These are unitary composition stones of a sintered or formed abrasive grit material in the form of an open-centered flat faced torus. A center bore 52 provides an opening within the center of the stone. Along an inner circumference of the stone are a series of stone grooves 48, each generally triangular grooves narrowing to a point 56, although the exact shape of the groove is not considered critical. The grooves do not extend for the entire ;diameter of this grinding stone, but rather end at an intermediate point 56 between the center bore 52 and the outer edge 54 of the stone. The remaining outer face 50 of the grinding stone is flat and forms the surface of the stone where the actual grinding is believed to take place.

Grinding in abrasive stones such as the stator abrasive stone 6 requires that an identical stone be placed face to face with the abrasive stone and rotated with respect to it to create a grinding action. The stator abrasive stone 6 is mounted to the stator 4 by means of a stone mounting clamp 10. A suitable such clamp and mounting method is disclosed in U.S. Pat. No. 4,841,623 "Method of Mounting Stones in Disc or Attrition Mills" to Rine. Alternatively, the stones herein described may be mounted to their respective stator 4 or rotor 12 by means of adhesives or the like.

The latter mounting has the advantage that more of the stone is available for wear before stone replacement is required. The clamp 10 extends above the level of the stator 4 or the rotor 12. In the course of grinding, the abrasive wear on the stone 6 lowers the heighth of the stone 6 to that of the stone mounting clamp 10. It is then necessary to replace the stone; an adhesive mounting of the stone permits the stone to be ground essentially down to the level of the stator, nearly doubling stone life.

Within hinged end section 5 of casing 3 is mounted a moveable stator 24. Moveable stator 24 is mounted to a shaft 26 which moves inward or outward with respect to the hinged end section 5, permitting placement of the moveable stator 24 towards or away from the stator 4. Any suitable method may be used for moving the moveable stator 24. In typical use, a shaft tooth section 28 is provided upon the moveable stator shaft 26. A stator positioning gear 30, driven by a hand crank or an electric motor, engages with the teeth 28 on stator shaft 26 to move the moveable stator 24 inward or outward with respect to the fixed stator 4.

Moveable stator 26 has an inward face 32. On face 32 a second stator abrasive stone 6 is mounted in the same manner as stator abrasive stone 6 is mounted to fixed stator 4. When so mounted, both the stator abrasive stone 6 mounted to the fixed stator 4 and the stator abrasive stone 6 mounted to the moveable stator 24 are facingly opposed to one another with a space 33 in between.

In this space 33 between the stator abrasive stones 6 is mounted a floating rotor 12; this is a steel disk rotor mounted on a floating shaft 14. Floating shaft 14 is supported by a moveable rotor shaft seal 16 within casing 3 for both rotary and lateral movement. Any one of a number of well-known floating drives permit such a rotor to rotate freely and yet freely slide in and out of the casing 3. Such drives are well-known in the art and are not shown here. A suitable such drive is sold as a Beloit Jones DD 4000 refiner or a Black Clawson Twin Hydradisk™ refiner, as used in the paper pulp industry.

Mounted to the rotor 14 are two rotor stones 20. Rotor stones 20 are of identical construction to stator abrasive stones 6 and are mounted back to back to the rotor 12 so that the rotor stone faces 22 are facing and opposed to the fixed stone grinding face 8 and the moveable stator grinding face 32.

A slurry inlet pipe 34 for providing a slurry 75 of rubber particles and water to be ground is mounted externally to casing 3 and passes through the casing 3. Pipe 34 provides a channel for the flow of slurry 75 through the stator bore 35, into a central open gap 36 formed by the center bores 52 of the grinding stones. Suitable openings or passages 18 are positioned within the center of the rotor 12 to permit free-flow of slurry 75 throughout the central gap 36. The facingly opposed stator and rotor stones 4, 20 are opposed face to face. This provides for two parallel grinding passages 38, one between stator grinding face 8 and rotor face 22, another between stator face 32 and rotor face 22.

Depending upon the desired fineness of grind of the rubber, there is generally considered to be an optimum grit size for the construction of the abrasive stones 6, 20. For a given grit size and a desired size of ground rubber there is found to be an optimum spacing between the opposing grinding stone faces and thus an optimum size for gap 38 between the stator grinding stones 6 and the rotor grinding stones 20.

It should be noted that the term ground rubber particle size here actually refers to the production of rubber particles smaller than a given ASTM sieve size; minus 80 mesh rubber, for example, is all particles small enough to pass an ASTM 80 mesh screen, and typically represents a distribution of particles having sizes ranging from 80 mesh to below 200 mesh. A "production rate" is the amount of such fine rubber produced, by weight, in a given time period by grinding.

This optimum gap 38 is experimentally determined to provide the best production rate for a desired rubber particle size for any given stone grit size. For a given rubber particle size there is a distinct optimum gap at which the production rate for the desired rubber particle size peaks; the rate of production of the desired rubber drops both for larger gaps, where the rubber is not so finely ground, and smaller gaps, where less rubber passes in a given time. A plot of the rubber production rate for the desired sieve size over a range of gap settings will therefore show a single distinct production peak, which occurs at the optimum gap setting.

It has also been discovered that as the stone grinding passage 38 is reduced in gap width, there is a steady increase in temperature rise in the slurry 75 passing through the double disc grinder 2. This is due to the increasing friction, and therefore energy converted to heat, as the gap is decreased. At a given grinding machine speed, this outlet temperature becomes a suitable indicator of gap 38 size.

Around the outside of the rotor stones 20, outside the outer edge 54 of each, is a ground slurry collection chamber 40 within the casing 3. Ground slurry collection chamber 40 connects to a slurry outlet pipe 42 passing the ground slurry 75A to the exterior of the double disc grinder. A temperature sensor 44 is mounted within the slurry outlet pipe 42 to monitor the temperature of the ground slurry 75A after it has passed through the double disk grinder.

In use, an optimum operating point for the double disk grinder of the invention can be found by correlating the temperature rise in the outlet slurry as sensed by the temperature sensor 44 with the experimentally determined rise in temperature as the size of the grinding gap 38 is reduced through the optimum gap. The sensed output temperature can thus be correlated to the known peak productivity point, which is the optimum gap size of the grinding passages 38 for a given set of stones 6,20 and for a given desired end particle size after grinding.

Once these values are known by experimentation or test, then the double disk grinder may be set for a production run by manipulating the stator positioning gear 30 by motor or by a hand crank so as to move the moveable stator 24 towards the fixed stator 4. So long as the rotor 12 is rotating, the rotor floating shaft 14 will position itself so that the rotor 12 is in a balanced position between both stators 4, 24. It is found that as any one of the grinding passages 38 become smaller than the other grinding passage 38, pressure generated by the centrifugal action of the rotating rotor stones 20 on the slurry 75 passing through the slurry grinding passage 38 increases in the smaller gap 38 and decreases in the larger gap 38, forcing the rotor 12 away from the direction of the stator 4, 24 having the smaller grinding passage 38. Thus, so long as the rotor 12 is turning and slurry or liquid 75 is flowing through the double disk grinder 2 the rotor 12 will balance itself so that each of the grinding passages 38 has an identical gap 38. Thus, it is necessary only to move the moveable stator 24 inward or outward to uniformly set both grinding gaps 38 to identical size widths.

Therefore, once the slurry temperature rise corresponding to the optimum grinding gap 38 is known for a given grit size of abrasive stones 6, 20 it is only necessary to monitor the outlet temperature through temperature sensor 44 and position the moveable stator 24 until the appropriate temperature rise is detected within the ground slurry 75A. Maintaining this temperature rise across the slurry 75 insures that the grinding passages 38 have been sent to a gap which is optimum for a given set of abrasive stone 6 and a desired output size of ground rubber.

It should be apparent that the described double disk grinder provides within a compact space for considerably larger abrasive stones than the vertical pigment mills of the prior art, and, in addition, provides for a considerably increased grinding surface. Since the actual grinding occurs upon the stone grinding face 50 at that point extending from the groove end point 56 to the edge 54 of the grinding stone, an increase in the diameter of the grinding stones can be seen to clearly radically increase the amount of area available for effective grinding of particles and, therefore, increase throughput. It is found that providing the grinding grooves 48 on the inner portion of the stone aids in setting up the centrifugal flow of slurry across the stone and in feeding.

We claim:

1. An apparatus for grinding a liquid based slurry of elastomeric particles into a fine form comprising:

a first fixed stator abrasive stone having a flat grinding face and a hollow center;

a second stator abrasive stone having a flat grinding face and a hollow center axially aligned in a spaced relation to said first fixed stator;

means for varying the spacing of said second stator stone from said first fixed stone;

a rotor having abrasive stones on each of two faces axially aligned with the stator stones, means for rotating said rotor with respect to said stator stones;

means for providing a flow of slurry of elastomeric particles into the center Of said rotor and said stators, said rotor freely floating axially between the two stators and being centered solely by the pressure of the slurry passing between each side of the rotor and the stators, whereby the rotor is self-centered between the stator stones.

2. The apparatus of claim 1 further comprising:

a central gap internal to the center of the stators for the inlet flow of a rubber containing slurry;

a chamber external to the rotor for the outlet flow of a slurry containing ground rubber;

said slurry flowing from said inlet flow to said outlet flow between said rotor and said stators.

3. The apparatus of claim 1 further comprising:

a temperature sensor for determining the temperature of said outlet flow and means for adjusting the spacing between said stator while operating to maintain a predetermined outlet temperature of the fine form of the particles.

4. The apparatus of claim 1, each said stator stone and each rotor stone comprising:

a torus having a hollow center bore, free of any spindle or obstruction and a flat face, a plurality of grooves in said flat face of each rotor stone extending radially from said center bore to a point intermediate the bore and the outer edge of the stone.

5. An apparatus for grinding a liquid based slurry of elastomeric particles into a fine form comprising:

a first stator stone, a second stator stone axially aligned in a spaced relation to said first stator stone, means for varying the spacing between said first and second stator stones, a rotor having abrasive stones on each side axially aligned intermediate said stator stones, means for rotating said rotor with respect to said stator stones, means for providing a radial flow of elastomeric particles between the rotor stones and the stator stones, a temperature sensor for determining the temperature of said outlet flow of elastomeric particles, and means for adjusting the spacing between the stator while operating to maintain a predetermined outlet temperature of the particles.

6. The apparatus according to claim 5 wherein said rotor is free to float axially between said stator stones to equalize the flow of particles through the spaces between the rotor stones and the stator stones.

7. The apparatus according to claim 6 wherein each of said stator stones and said rotor stones includes a hollow center whereby said elastomeric particles pass into the hollow center of the stones and outwardly between the stator stones and the rotor stones.

* * * * *